US011802695B2

(12) United States Patent
Shimazaki et al.

(10) Patent No.: US 11,802,695 B2
(45) Date of Patent: Oct. 31, 2023

(54) OUTDOOR UNIT OF AIR-CONDITIONING APPARATUS

(71) Applicant: Mitsubishi Electric Corporation, Tokyo (JP)

(72) Inventors: Misaki Shimazaki, Tokyo (JP); Kei Furukubo, Tokyo (JP); Kazuhisa Iwasaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 290 days.

(21) Appl. No.: 17/293,238

(22) PCT Filed: Jan. 18, 2019

(86) PCT No.: PCT/JP2019/001461
§ 371 (c)(1),
(2) Date: May 12, 2021

(87) PCT Pub. No.: WO2020/148888
PCT Pub. Date: Jul. 23, 2020

(65) Prior Publication Data

US 2022/0049857 A1 Feb. 17, 2022

(51) Int. Cl.
*F24F 1/36* (2011.01)
*F24F 11/42* (2018.01)
*F24F 13/22* (2006.01)

(52) U.S. Cl.
CPC ..... *F24F 1/36* (2013.01); *F24F 11/42* (2018.01); *F24F 13/22* (2013.01); *F24F 2221/34* (2013.01)

(58) Field of Classification Search
CPC .... F24F 1/36; F24F 11/42; F24F 13/22; F24F 13/222; F24F 2013/227; F24F 2013/228; F24F 2221/34
See application file for complete search history.

(56) References Cited

U.S. PATENT DOCUMENTS 3,077,084 A 2/1963 Kanter
2014/0298844 A1 10/2014 Luo et al.
(Continued)

FOREIGN PATENT DOCUMENTS

JP H06-281201 A 10/1994
JP 2010-032206 A 2/2010
(Continued)

OTHER PUBLICATIONS

Extended European Search Report dated Jan. 3, 2022 issued in corresponding European patent application No. 19909974.8.
(Continued)

*Primary Examiner* — Jonathan Bradford
(74) *Attorney, Agent, or Firm* — POSZ LAW GROUP, PLC

(57) ABSTRACT

An outdoor unit of an air-conditioning apparatus includes a housing, a heat exchanger, a bottom plate, a drainage structure, and a heater. The housing has an opening through a side of the housing. The heat exchanger is disposed in an upper portion of the interior of the housing. The bottom plate is disposed at the bottom of the housing, and has a drainage hole through which to drain out drain water generated at the heat exchanger. The drainage structure is disposed below the heat exchanger and that guides the drain water to the bottom plate. The drainage structure includes a side panel that covers the opening of the housing, and a water guide plate disposed inside the housing and facing the side panel. The water guide plate and the side panel define a drainage path for draining the drain water between the water guide plate and the side panel.

17 Claims, 12 Drawing Sheets

(56) References Cited

U.S. PATENT DOCUMENTS

| | | | |
|---|---|---|---|
| 2015/0121934 | A1 | 5/2015 | Yamaguchi et al. |
| 2019/0128542 | A1 | 5/2019 | Furukubo et al. |

FOREIGN PATENT DOCUMENTS

| | | | |
|---|---|---|---|
| JP | 2010-071514 | A | 4/2010 |
| JP | 2015-090260 | A | 5/2015 |
| JP | 2015-206575 | A | 11/2015 |
| JP | 2017-117540 | A | 6/2017 |
| KR | 2004-0098275 | A | 11/2004 |
| KR | 10-0736616 | B1 | 7/2007 |
| WO | 2011/030678 | A1 | 3/2011 |
| WO | 2013/088713 | A1 | 6/2013 |
| WO | 2018/011939 | A1 | 1/2018 |

OTHER PUBLICATIONS

International Search Report dated Feb. 26, 2019, in corresponding International Application PCT/JP2019/001461 (and English translation).

Office Action dated Oct. 5, 2021, issued in corresponding JP Patent Application No. 2020-566070 (and English Machine Translation).

OUTDOOR UNIT OF AIR-CONDITIONING APPARATUS

CROSS REFERENCE TO RELATED APPLICATION

This application is a U.S. National Stage Application of International Application No. PCT/JP2019/001461, filed on Jan. 18, 2019, the contents of which are incorporated herein by reference.

TECHNICAL FIELD

The present disclosure relates to an outdoor unit of an air-conditioning apparatus, the outdoor unit including a drainage structure for draining drain water generated at a heat exchanger.

BACKGROUND ART

As is known, typical air-conditioning apparatuses use, for example, a flow switching device such as a four-way valve to switch the flows of refrigerant to thereby perform a cooling operation and a heating operation. If such an air-conditioning apparatus is operated to perform heating at low outside air temperatures, frost may form on a heat exchanger of an outdoor unit, leading to potential decrease in heat exchange efficiency. To address such a problem, the outdoor unit is typically configured to defrost the outdoor unit to remove frost.

In the outdoor unit, frost melted by defrosting is allowed to flow downward as drain water, which is then received on a bottom plate of the outdoor unit before being drained out through a drainage hole provided in the bottom plate. However, in some cases, a small portion of the drain water received by the bottom plate may remain on the bottom plate without reaching the drainage hole. The drain water remaining on the bottom plate may freeze again if the outside temperature is at or below the freezing point when the operation returns to heating after the end of defrosting. As the heat exchanger is defrosted repeatedly on a regular basis, once freezing of drain water occurs, the freezing continues to proceed. This may lead to a decrease in heating capacity as the heating exchanger becomes covered in ice, or to crushing of a pipe as ice increases. To address this problem, for example, Patent Literatures 1 and 2 each disclose a technique that uses an anti-freeze heater installed on a bottom plate of an outdoor unit to prevent freezing of drain water.

CITATION LIST

Patent Literature

Patent Literature 1: International Publication No. 2011/030678

Patent Literature 2: International Publication No. 2013/088713

SUMMARY OF INVENTION

Technical Problem

The approach employed by the outdoor unit of an air-conditioning apparatus disclosed in each of Patent Literatures 1 and 2, that is, installing an anti-freeze heater on the bottom plate, still fails to completely prevent freezing. That is, the anti-freeze heater actually melts ice only in an area of about several millimeters around the anti-freeze heater, which creates a void inside the ice. This means that in an outdoor unit equipped with an anti-freeze heater, icing eventually occurs even on an upper portion of the anti-freeze heater, which results in ice forming on the entire bottom plate. This may lead to breakage of a refrigerant pipe of the heat exchanger.

In one conceivable configuration of an outdoor unit of an air-conditioning apparatus, a heat exchanger is supported in an upper portion of the interior of a housing, with a drainage structure disposed below the heat exchanger to guide drain water to a bottom plate. However, when operating under cold climate environments, the outdoor unit may encounter a situation where, as freezing of drain water proceeds to an upper portion of the drainage structure after a lower portion of the drainage structure is buried in icing, the freezing of drain water further proceeds to the heat exchanger and the heat exchanger becomes covered in icing, which may cause a decrease in the heating capacity of the heat exchanger or crushing of a pipe included in the heat exchanger. Further, dripping drain water may enter, through a portion of the icing that has increased, an inner portion of the housing 1 where a compressor, an accumulator, and other internal components are disposed.

The present disclosure has been made to address the above-mentioned problems. It is an object of the present disclosure to provide an outdoor unit of an air-conditioning apparatus, the outdoor unit being capable of, even if freezing proceeds to an upper portion of a drainage structure after a lower portion of the drainage structure is buried in icing, preventing a decrease in the heating capacity of a heat exchanger and breakage of a refrigerant pipe, and further preventing entry of dripping drain water into an inner portion of a housing.

Solution to Problem

An outdoor unit of an air-conditioning apparatus according to an embodiment of the present disclosure includes a housing, a heat exchanger, a bottom plate, a drainage structure, and a heating means. The housing has an opening through a side of the housing. The heat exchanger is disposed in an upper portion of the interior of the housing. The bottom plate is disposed at the bottom of the housing, and has a drainage hole through which to drain out drain water generated at the heat exchanger. The drainage structure is disposed below the heat exchanger and that guides the drain water to the bottom plate. The heating means is configured to heat the drainage structure. The drainage structure includes a side panel that covers the opening of the housing, and a water guide plate disposed inside the housing and facing the side panel. The water guide plate and the side panel define a drainage path for draining the drain water between the water guide plate and the side panel. The heating means is configured to heat at least an upper portion of the side panel.

Advantageous Effects of Invention

The outdoor unit of an air-conditioning apparatus according to an embodiment of the present disclosure includes the heating means configured to heat at least an upper portion of the side panel, which is included in the drainage structure. As a result, even if a lower portion of the drainage structure becomes buried in icing and then the icing increases to an upper portion of the drainage structure, the icing is melted by the heating means, and drained to the outside of the side panel from an upper end portion of the drainage structure. This makes it possible to prevent a decrease in the heating capacity of the heat exchanger and breakage of the refrigerant pipe, and further prevent entry of dripping drain water into an inner portion of the housing.

DESCRIPTION OF EMBODIMENTS

Embodiment 1

Embodiments of the present disclosure are described below with reference to the drawings. In the figures, the same or corresponding features are denoted by the same reference signs to omit or simplify their description as appropriate. Components illustrated in the figures may be changed as appropriate in their shape, size, placement, or other details within the scope of the present disclosure.

Figure 1:
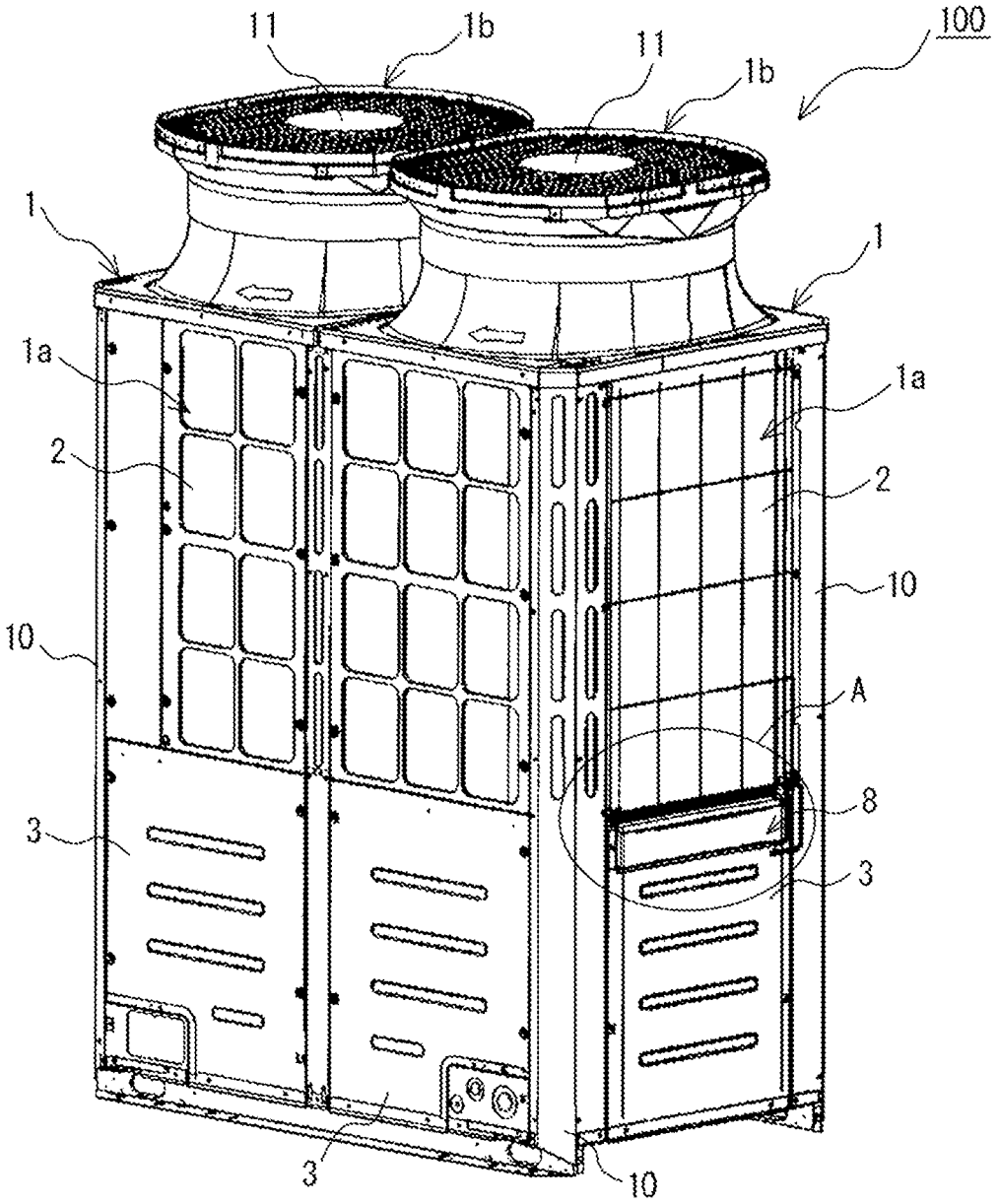
FIG. 1 is a perspective view of an outdoor unit of an air-conditioning apparatus according to Embodiment 1 of the present disclosure.
Figure 2:
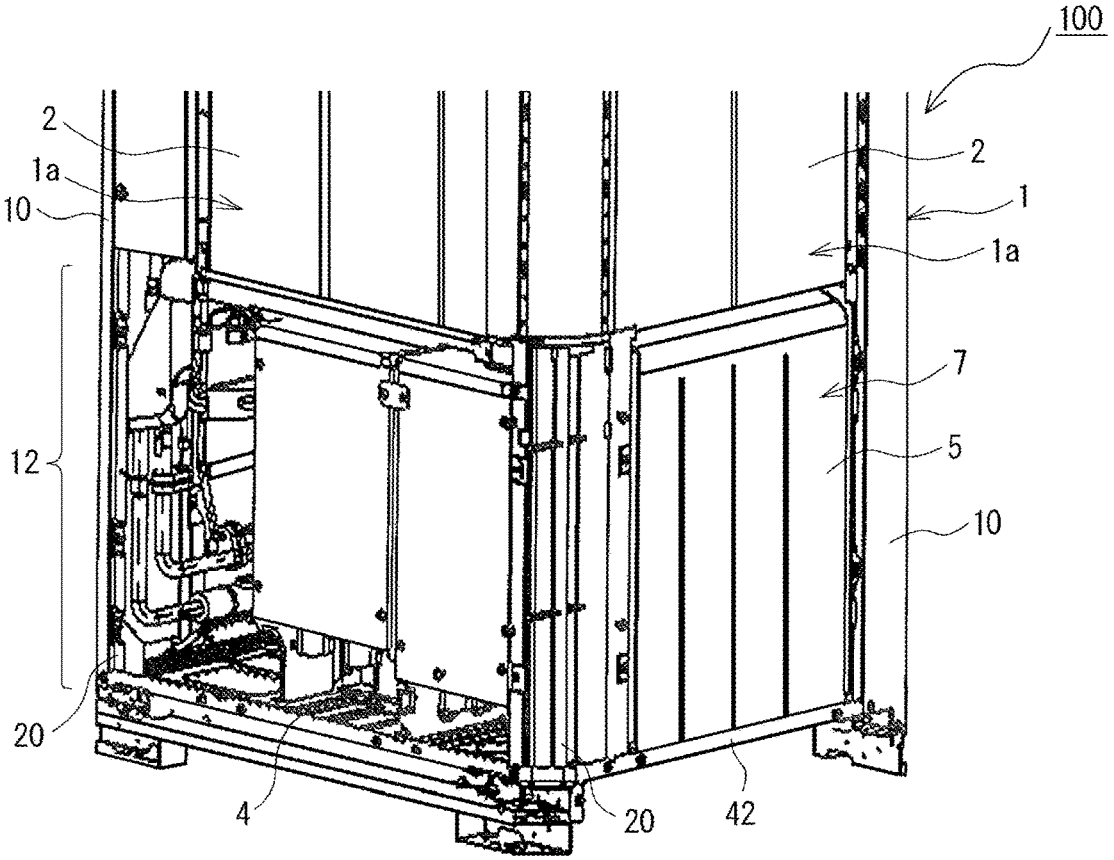
FIG. 2 is an enlarged perspective view of the internal configuration of the outdoor unit of an air-conditioning apparatus according to Embodiment 1 of the present disclosure.
Figure 3:
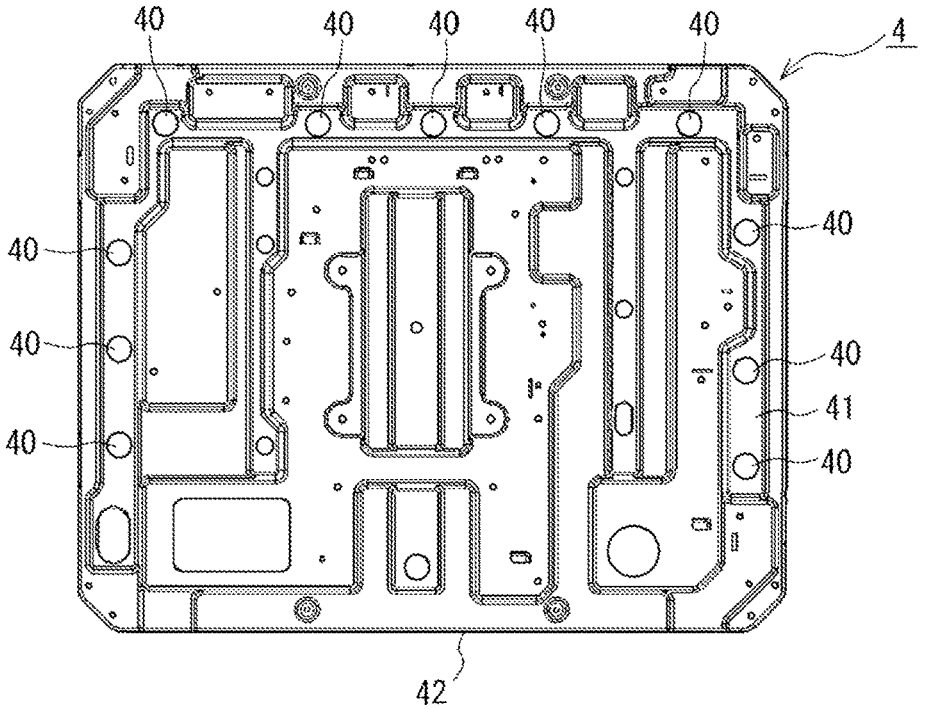
FIG. 3 is a top view of a bottom plate of the outdoor unit of an air-conditioning apparatus according to Embodiment 1 of the present disclosure.
Figure 4:
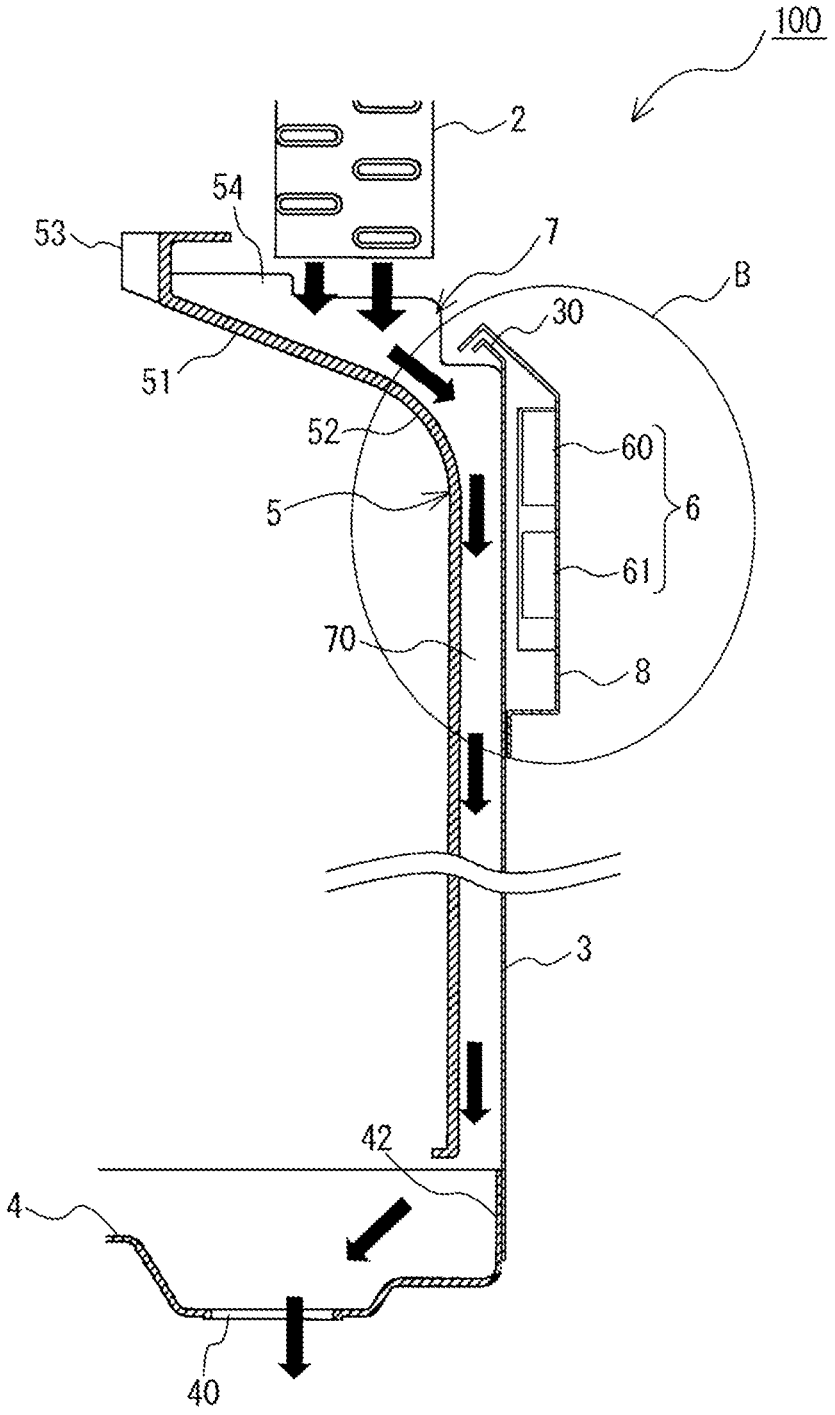
FIG. 4 is a schematic cross-sectional view of a drainage structure of the outdoor unit of an air-conditioning apparatus according to Embodiment 1 of the present disclosure.
Figure 5:
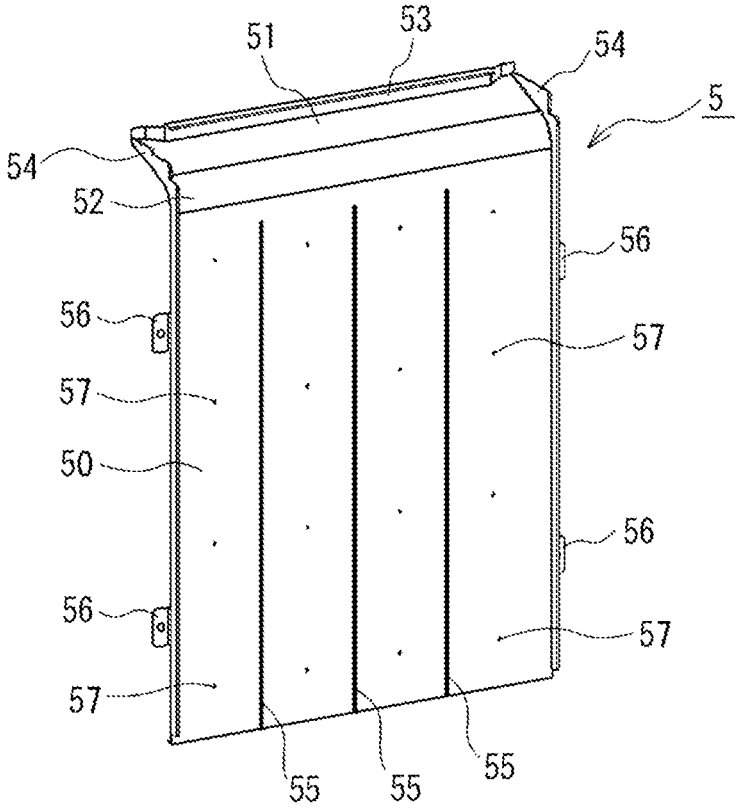
FIG. 5 is a perspective view of a water guide plate of the outdoor unit of an air-conditioning apparatus according to Embodiment 1 of the present disclosure, as seen toward a drainage surface of the water guide plate.

FIG. 1 is a perspective view of an outdoor unit of an air-conditioning apparatus according to Embodiment 1 of the present disclosure. FIG. 2 is an enlarged perspective view of the internal configuration of the outdoor unit of an air-conditioning apparatus according to Embodiment 1 of the present disclosure. FIG. 3 is a top view of a bottom plate of the outdoor unit of an air-conditioning apparatus according to Embodiment 1 of the present disclosure. FIG. 4 is a schematic cross-sectional view of a drainage structure of the outdoor unit of an air-conditioning apparatus according to Embodiment 1 of the present disclosure. FIG. 5 is a perspective view of a water guide plate of the outdoor unit of an air-conditioning apparatus according to Embodiment 1 of the present disclosure, as seen toward a drainage surface of the water guide plate.

As illustrated in FIGS. 1 to 4, an outdoor unit 100 according to Embodiment 1 includes a longitudinally mounted, substantially cuboid housing 1, a heat exchanger 2 disposed in an upper portion of the interior of the housing 1, a bottom plate 4 with drainage holes 40 through which to drain out drain water generated at the heat exchanger 2, a support base 20 for supporting the heat exchanger 2 in the upper portion of the interior of the housing 1, a drainage structure 7 that guides drain water to the bottom plate 4, and a heating means 6 that heats the drainage structure 7.

As illustrated in FIGS. 1 and 2, the housing 1 includes a frame 10 extending upward from each corner portion of the bottom plate 4 disposed at the bottom of the housing 1. The housing 1 has an air inlet 1*a* through which to suction air. The air inlet 1*a* is provided at upper portions of sides of the housing 1 surrounded by the frame 10. The heat exchanger 2 is disposed along the air inlet 1*a*. The housing 1 has an air outlet 1*b* on the top of the housing 1. A fan 11 is disposed inside the housing 1 and directly below the air outlet 1*b*. As the fan 11 is driven, air suctioned into the housing 1 through the air inlet 1*a* passes through the heat exchanger 2 for heat exchange with refrigerant, and is then discharged through the air outlet 1*b* via the fan 11.

As illustrated in FIG. 1, a side panel 3, which is a design metal sheet, is disposed at a lower portion of each side of the housing 1 surrounded by the frame 10. The lower portion of each side of the housing 1 is closed off by the side panel 3. The side panel 3 is secured at the left and right side edges to the frame 10 with fastening components such as screws, and secured at the lower edge to the bottom plate 4 with fastening components such as screws. As illustrated in FIG. 4, the side panel 3 has a first hook-shaped part 30, which is formed by bending an upper end portion of the side panel 3 toward the interior of the housing 1. As illustrated in FIG. 2, for example, internal components 12 such as a compressor and an accumulator are installed below the heat exchanger 2, that is, in a lower portion of the interior of the housing 1. By removing the side panel 3 from the housing 1 of the outdoor unit 100, maintenance or other operations can be performed on the internal components 12.

The heat exchanger 2 is configured to exchange heat between refrigerant supplied to the heat exchanger 2, and air passing through the heat exchanger 2. In cooling operation, the heat exchanger 2 is used as a condenser to condense and liquefy refrigerant, and in heating operation, the heat exchanger 2 is used as an evaporator to evaporate and gasify refrigerant. The heat exchanger 2 is made up of two L-shaped heat exchangers combined into a substantially square shape. As illustrated in FIGS. 1 and 2, the heat exchanger 2 is disposed with its outer surface extending along the inner surface of the housing 1. The heat exchanger 2 is supported in an upper portion of the interior of the housing 1 by use of the support base 20 disposed inside the housing 1.

As illustrated in FIGS. 2 and 3, the bottom plate 4 has a substantially rectangular shape, and is disposed at the bottom of the housing 1. The bottom plate 4 is used to place the internal components 12 on the bottom plate 4. The bottom plate 4 has a rising part 42 formed by bending the outer periphery edges of the bottom plate 4 upward. As illustrated in FIGS. 3 and 4, the bottom plate 4 has the drainage holes 40 for draining out drain water generated by melting of frost by the defrost operation, and a drainage groove 41 for guiding drain water to the drainage holes 40. The support base 20, which supports the heat exchanger 2, is secured in a lower end portion to each corner portion of the bottom plate 4.

As illustrated in FIG. 4, the drainage structure 7 includes the side panel 3, and a water guide plate 5. The water guide plate 5 is disposed inside the housing 1 such that the water guide plate 5 faces the side panel 3 with a space between the water guide plate 5 and the side panel 3. The water guide plate 5 and the side panel 3 define a drainage path 70 for draining drain water between the water guide plate 5 and the side panel 3. The drainage path 70 is a path along which frost melted by defrosting is directed toward a lower portion of the outdoor unit 100 (in the direction indicated by arrows in FIG. 4). The drainage path 70 guides the drain water to the drainage groove 41 of the bottom plate 4. To increase the space to the extent possible for installing the internal components 12 inside the housing 1, the spacing between the water guide plate 5 and the side panel 3 is calculated on the basis of the minimum volume required of the flow of rain water or other water under non-cold-climate environments.

As illustrated in FIG. 5, the water guide plate 5 is a component with a substantially flat shape that is made of, for example, a material such as synthetic resin or rubber with a low thermal conductivity. The reason for the low thermal conductivity is to ensure that drain water leaving the heat exchanger 2 does not immediately ice up as the water guide plate 5 removes heat away from the drain water. The water guide plate 5 has an inclined part 51 in an upper end portion. The inclined part 51 is inclined at an angle of about 30 degrees obliquely upward toward the interior of the housing 1. As illustrated in FIG. 4, the upper end of the inclined part 51 is positioned higher than the upper end of the side panel 3. An upper end portion of the inclined part 51 is provided with a flange part 53, which extends upward. This is to prevent entry of dripping drain water into an inner portion of the housing 1. The water guide plate 5 is not in contact with the heat exchanger 2.

The water guide plate 5 has a curved part 52, which is formed by rounding a corner portion where the water guide plate 5 transitions from the inclined part 51 into a surface facing the side panel 3. This allows drain water dripping from the heat exchanger 2 to be smoothly guided downward through the drainage path 70 without pooling in the inclined part 51. The left and right side edges of the water guide plate 5 each have a flange part 54 that closes off the drainage path 70. This helps to prevent entry of drain water into an inner portion of the housing 1. The water guide plate 5 is secured at opposite side edges to the support base 20 by use of mounting parts 56 provided to each of the left and right flange parts 54. The mounting parts 56 each have a hole through which to pass a fastening component such as a bolt and a screw. Each mounting part 56 is secured to the support base 20 with the fastening component passed through the hole. Although each of the left and right flange parts 54 has two mounting parts 56 provided in the vertical direction of the flange part 54 in the illustrated example, each flange part 54 may have any number of mounting parts 56 greater than or equal to one.

The water guide plate 5 has a drainage surface 50 with three reinforcing longitudinal ribs 55 that are spaced apart in the lateral direction. Although not illustrated, the back surface of the water guide plate 5 has three reinforcing transverse ribs that are spaced apart in the vertical direction. The longitudinal ribs 55 and the transverse ribs are provided to ensure that, if the water guide plate 5 is formed as a flat resin molded component, the water guide plate 5 does not warp at the time of molding. The longitudinal ribs 55 are disposed to extend in the longitudinal direction, which is the same as the direction of flow of drain water to ensure that the longitudinal ribs 55 do not obstruct the drainage path 70. Each of the number of longitudinal ribs 55 and the number of transverse ribs is not limited to three.

The water guide plate 5 has plural through-holes 57 extending through the water guide plate 5 from the drainage path 70 toward the interior of the housing 1. As illustrated in FIG. 5, the through-holes 57 are used as freezing-expansion relief holes to ensure that the drainage path 70 does not expand as icing and melting are repeated. The through-holes 57 are provided to prevent expansion when icing occurs. Although the through-holes 57 are illustrated to include four spaced through-holes in the longitudinal direction and four spaced through-holes in the transverse direction, the arrangement of the through-holes are not limited to the arrangement thus described. The number and size of the through-holes 57 to be provided may be adjusted as appropriate.

Although not illustrated in the drawings in detail, the water guide plate 5 may be improved in water repellency by texturing or grooving the drainage surface 50 formed by resin molding.

The heating means 6 is provided to heat and melt icing that has increased to an upper portion of the interior of the drainage path 70 after a lower portion of the drainage path 70 is covered in icing, so that the melted ice is drained to the outside of the side panel 3 from an upper end portion of the drainage path 70. That is, the heating means 6 mainly heats an upper portion of the outer surface of the side panel 3.

Figure 6:
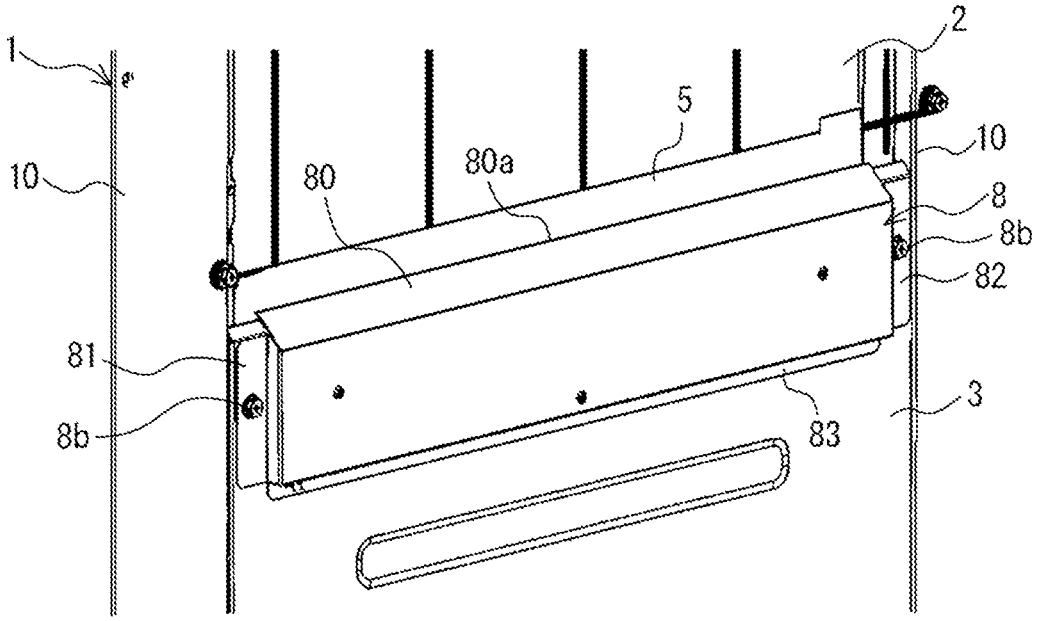
FIG. 6 is an enlarged view of a portion A illustrated in FIG. 1.
Figure 7:
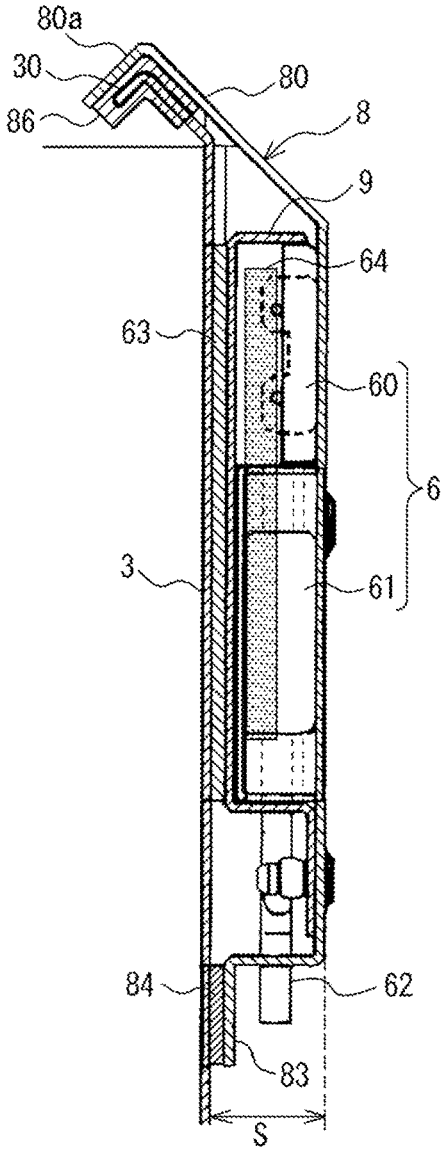
FIG. 7 is an enlarged view of a portion B illustrated in FIG. 4.
Figure 8:
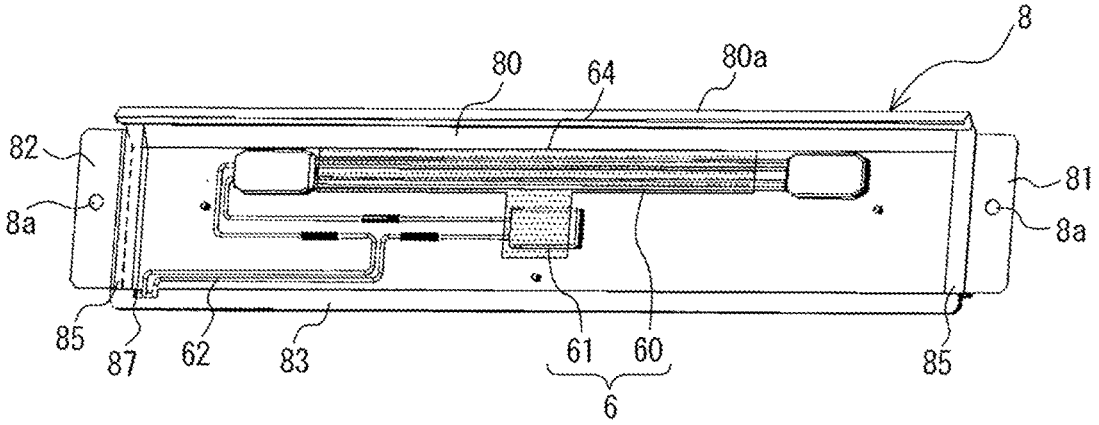
FIG. 8 is a perspective view of a mounting bracket of the outdoor unit of an air-conditioning apparatus according to Embodiment 1 of the present disclosure, with a heating means accommodated inside the mounting bracket.
Figure 9:
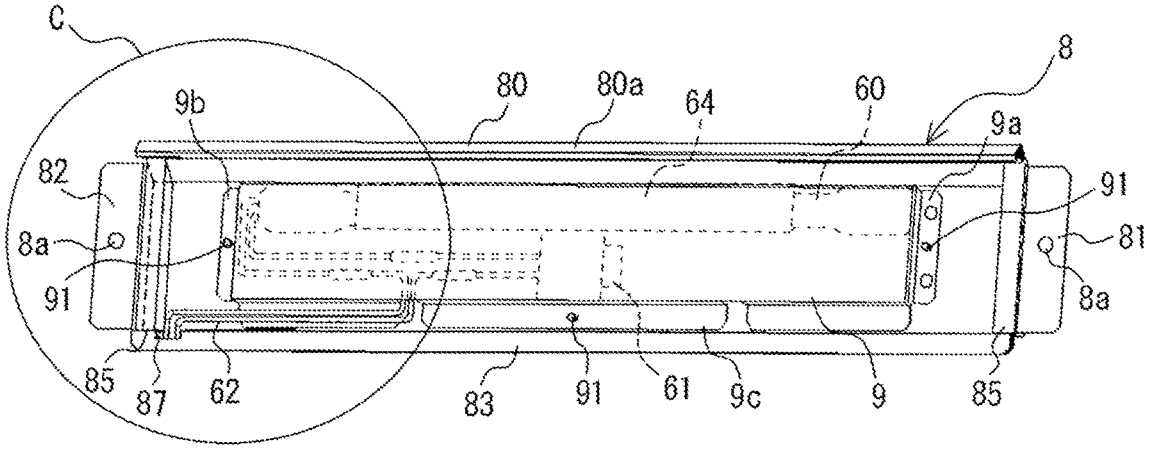
FIG. 9 is a perspective view of the mounting bracket of the outdoor unit of an air-conditioning apparatus according to Embodiment 1 of the present disclosure, with the heating means and an inner metal sheet accommodated inside the mounting bracket.
Figure 10:
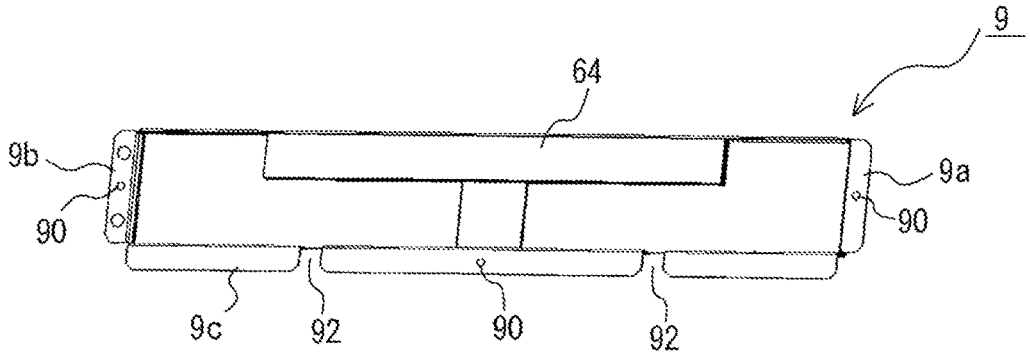
FIG. 10 is a perspective view of the inner metal sheet of the outdoor unit of an air-conditioning apparatus according to Embodiment 1 of the present disclosure.
Figure 11:
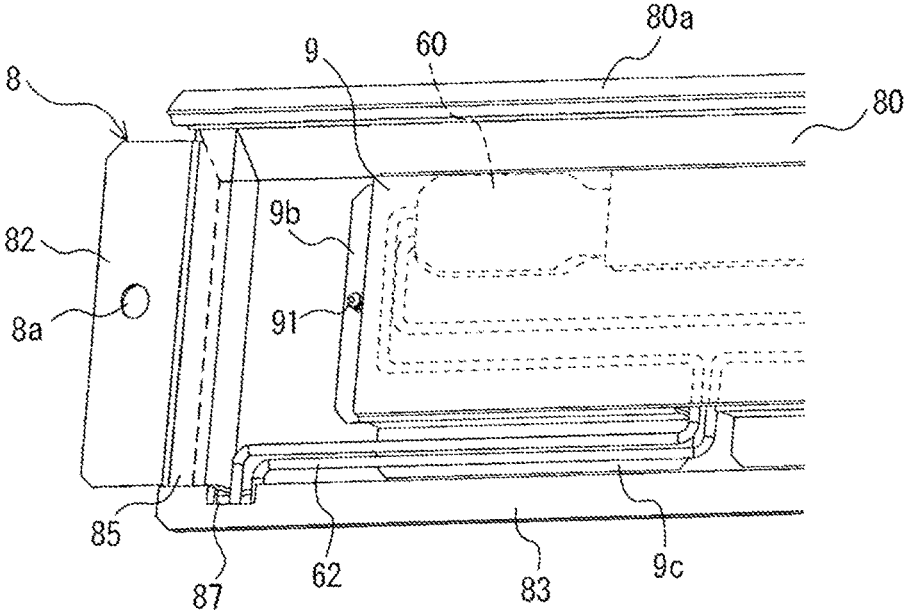
FIG. 11 is an enlarged view of a portion C illustrated in FIG. 9.

FIG. 6 is an enlarged view of a portion A illustrated in FIG. 1. FIG. 7 is an enlarged view of a portion B illustrated in FIG. 4. FIG. 8 is a perspective view of a mounting bracket of the outdoor unit of an air-conditioning apparatus according to Embodiment 1 of the present disclosure, with the heating means accommodated inside the mounting bracket. FIG. 9 is a perspective view of the mounting bracket of the outdoor unit of an air-conditioning apparatus according to Embodiment 1 of the present disclosure, with the heating means and an inner metal sheet accommodated inside the mounting bracket. FIG. 10 is a perspective view of the inner metal sheet of the outdoor unit of an air-conditioning apparatus according to Embodiment 1 of the present disclosure. FIG. 11 is an enlarged view of a portion C illustrated in FIG. 9.

As illustrated in FIGS. 7 to 9, the heating means 6 includes a heater 60, and a temperature detection means 61 that detects the temperature of the surroundings heated by the heater 60. As illustrated in FIGS. 6 and 7, the heating means 6 is disposed such that the heating means 6 faces the outer surface of the side panel 3, and retained by a mounting bracket 8 disposed in an upper portion of the outer surface of the side panel 3. In the illustrated example, the temperature detection means 61 is disposed below the heater 60.

As illustrated in FIGS. 7 to 11, an inner metal sheet 9 is disposed inside the mounting bracket 8 between the heating means 6 and the side panel 3 and protects the heating means 6. A first heat-insulating component 63 is disposed between the inner metal sheet 9 and the side panel 3. Further, a second heat-insulating component 64 is disposed between the inner metal sheet 9 and the heating means 6. The first heat-insulating component 63 is provided to keep heat generated by the heating means 6 from being transmitted to the side panel 3. The second heat-insulating component 64 is provided to keep heat generated by the heating means 6 from being transmitted to the inner metal sheet 9. The reason for employing the above configuration is that melting of the ice inside the drainage path 70 due to the heating means 6 may result in a freezing-and-melting process, and this may lead to deformation of the water guide plate 5, which is a resin panel. It is to be noted that the second heat-insulating component 64 is also used to hold down and retain the heating means 6. The first heat-insulating component 63 and the second heat-insulating component 64 may not necessarily be provided. Depending on the installation circumstances, these heat-insulating components may be omitted, or only one of the two heat-insulating components may be provided.

As illustrated in FIGS. 6 and 8, the heating means 6 is disposed along the breadth of the side panel 3. The greater the flow of drain water, the less likely the drain water is to pool and ice up. It is thus desirable to place the heater 60 of the heating means 6 at the center along the breadth of the side panel 3 to thereby provide increased heating to the central portion. This is to improve drainage efficiency by causing drain water from the left and right sides to be collected in the central portion along the breadth of the side panel 3.

The temperature detection means 61 is, for example, a thermistor, and provided to ensure safety of the heater 60 disposed outside the housing 1. For example, the heater 60 is controlled by a controller, which is not illustrated, on the basis of a temperature detected by the temperature detection means 61. The heating means 6 may not necessarily include the temperature detection means 61 but may include only the heater 60.

As illustrated in FIGS. 6 to 8, the mounting bracket 8 is in the form of a rectangular box with an open side that faces the side panel 3. The mounting bracket 8 has an upper surface 80 inclined toward the housing 1. The mounting bracket 8 has, in an upper end portion of the upper surface 80, a second hook-shaped part 80*a* formed by bending the upper end portion toward the interior of the housing 1. The mounting bracket 8 also has a left flange part 81 and a right flange part 82, which respectively extend along the left and right edges of the open side of the mounting bracket 8 and project outward, and a lower flange part 83, which extends along the lower edge of the open side of the mounting bracket 8 and projects outward. The mounting bracket 8 is joined to the frame 10 with a joining component 8*b* such as a screw, which is passed through a through-hole 8*a* provided in each of the left flange part 81 and the right flange part 82. The joining component 8*b* is joined to the frame 10 with a spacer such as a washer between the joining component 8*b* and the frame 10.

As illustrated in FIG. 7, the mounting bracket 8 is mounted to the outer surface of the side panel 3 by placing the second hook-shaped part 80*a* over the first hook-shaped part 30. In the outdoor unit 100 of an air-conditioning apparatus, the first hook-shaped part 30 is thus covered by the second hook-shaped part 80*a*. This makes it possible to block the route of water entry, thus preventing entry of water into the interior space enclosed by the side panel 3 and the mounting bracket 8. In other words, the heating means 6 retained inside the mounting bracket 8 is protected from water. This helps to prevent the heating means 6 from breaking down. As the mounting bracket 8 is retained to the side panel 3 by simply hooking the first hook-shaped part 30 over the second hook-shaped part 80*a*, installation is facilitated. Further, the upper surface 80 of the mounting bracket 8 is inclined toward the housing 1 as described above. The resultant slope is used to improve drainage.

As illustrated in FIG. 7, it is desirable to provide a sealing component 86 in the gap between an upper portion of the mounting bracket 8 and an upper portion of the side panel 3 to seal the gap. This is to completely block the route of water entry, thus reliably preventing water from entering the interior space enclosed by the side panel 3 and the mounting bracket 8. The sealing component 86 is made of, for example, silicone.

As illustrated in FIG. 7, a first cushioning component 84 is disposed between the lower flange part 83 and the side panel 3. This is to inhibit heat from being transmitted to the side panel 3, which has a large heat capacity, via the lower flange part 83, which has been heated by the heater 60. In other words, the presence of the first cushioning component 84 helps to confine heat inside the mounting bracket 8, which allows for efficient heating of an upper portion of the side panel 3. The presence of the first cushioning component 84 also helps to prevent water droplets from entering the interior space through the gap between the lower flange part 83 and the side panel 3. The first cushioning component 84 may not necessarily be provided. Depending on the installation circumstances, the first cushioning component 84 may not be provided.

As illustrated in FIG. 8, second cushioning components 85 are each disposed inside the mounting bracket 8 and adjacent to the corresponding one of the left and right sides of the mounting bracket 8. The second cushioning component 85 is provided to prevent water from entering the interior space enclosed by the side panel 3 and the mounting bracket 8, thus protecting the heating means 6 from water. The second cushioning component 85 may not necessarily be provided. Depending on the installation circumstances, the second cushioning component 85 may not be provided.

As illustrated in FIGS. 6 and 7, the mounting bracket 8 is sized to fit within a range S of less than or equal to 15 mm in a horizontally outward direction from the outer surface of the side panel 3. This helps to ensure that if plural outdoor units 100 are arranged successively side by side in a concentrated manner as illustrated in FIG. 1, interference between adjacent outdoor units 100 is reduced to thereby increase available installation space to the extent possible. However, if the installation space for each outdoor unit 100 does not need to be considered, then the maximum thickness of the mounting bracket 8 is determined from the amount of heat generated by the heater 60, and the distance between the heater 60 and the location to be heated.

As illustrated in FIG. 8, the mounting bracket 8 has a first extraction opening 87 through which to pass a wire 62 connected to the heating means 6.

As illustrated in FIGS. 9 and 10, the inner metal sheet 9 is in the form of a rectangular box with an open side that faces toward the mounting bracket 8. The inner metal sheet 9 protects the heating means 6 retained inside the mounting bracket 8 from water by covering the surroundings of the heating means 6, and is also used as a heat insulator that allows for improved internal heat retention by protecting the heating means 6 from the side panel 3, which has been cooled by exposure to the outside air.

The inner metal sheet 9 has a left flange surface 9*a* and a right flange surface 9*b*, which respectively extend along the left and right edges of the open side of the inner metal sheet 9 and project outward, and a lower flange surface 9*c*, which extends along the lower edge of the open side of the inner metal sheet 9 and projects outward. The left flange surface 9*a*, the right flange surface 9*b*, and the lower flange surface 9*c* each have a through-hole 90 through which to pass a joining component 91 such as a screw. The inner metal sheet 9 is joined to the mounting bracket 8 by bringing the left flange surface 9*a*, the right flange surface 9*b*, and the lower flange surface 9*c* into contact with the inner surface of the mounting bracket 8, and then passing the joining component 91 through each through-hole 90.

The lower flange surface 9*c* of the inner metal sheet 9 has two second extraction openings 92 through which to pass the wire 62 connected to the heating means 6. The second extraction openings 92 are positioned offset such that the second extraction openings 92 are prevented from overlapping with the first extraction opening 87. In the outdoor unit 100, water droplets accumulating on the lower surface of the mounting bracket 8 may enter the outdoor unit 100 through the first extraction opening 87 along the wire 62. The entry of water may cause the heating means 6 to break down. In the outdoor unit 100 of an air-conditioning apparatus according to Embodiment 1, even if water droplets enter the outdoor unit 100 through the first extraction opening 87, the water is held back between the first extraction opening 87 and the second extraction openings 92 to prevent the water from reaching the heating means 6. This helps to prevent the heating means 6 from breaking down. Depending on the installation circumstances, the inner metal sheet 9 with the above-mentioned structure may not be provided.

Figure 12:
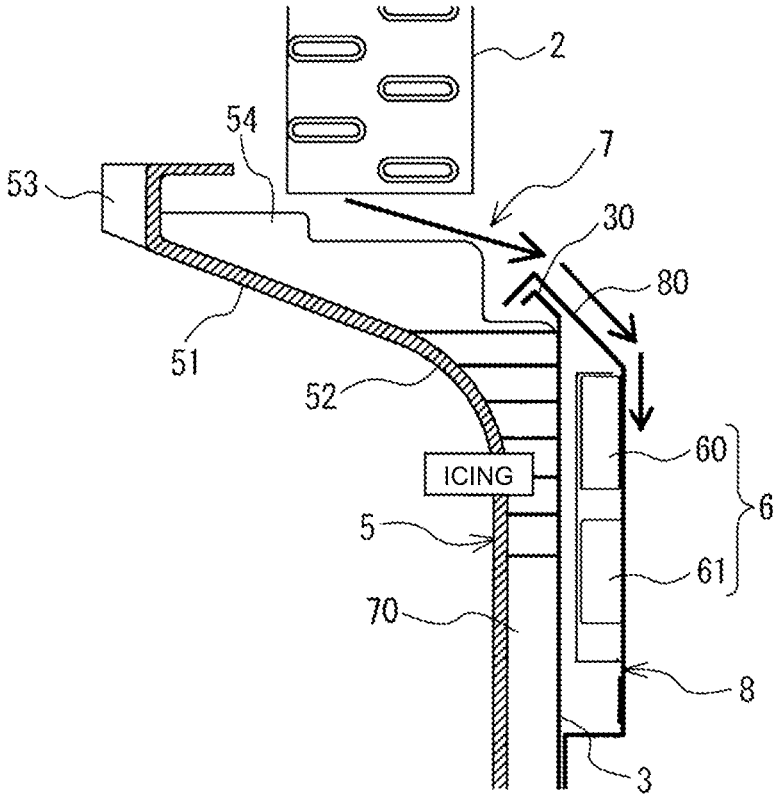
FIG. 12 illustrates the outdoor unit of an air-conditioning apparatus according to Embodiment 1 of the present disclosure, with drain water icing up in an upper portion of a drainage path.

FIG. 12 illustrates the outdoor unit of an air-conditioning apparatus according to Embodiment 1 of the present disclosure, with drain water icing up in an upper portion of the drainage path. In the outdoor unit 100 of an air-conditioning apparatus, frost melted by defrosting turns into drain water, which may in some cases remain on the bottom plate 4 without reaching any of the drainage holes 40. The drain water remaining on the bottom plate may freeze again if the outside temperature is at or below the freezing point when the operation returns to heating after the end of defrosting. Under cold climate environments, the outdoor unit 100 may sometimes encounter a situation where, after a lower portion of the drainage path 70 is buried in icing, the icing increases upward inside the drainage path 70 as illustrated in FIG. 12. As the outdoor unit 100 is defrosted repeatedly on a regular basis, when icing of the drain water increases to an upper portion of the drainage path 70 and the icing of the drain water further proceeds to the heat exchanger, the heat exchanger 2 may become covered in icing, which may cause the heating capacity of the heat exchanger 2 to decrease or may cause a pipe included in the heat exchanger 2 to crush. Further, dripping drain water may enter an inner portion of the housing 1 via the portion of the icing that has increased.

To address the above-mentioned problem, the outdoor unit 100 of an air-conditioning apparatus according to Embodiment 1 includes the housing 1, the heat exchanger 2 disposed in an upper portion of the interior of the housing 1, the bottom plate 4 disposed at the bottom of the housing 1 and having the drainage holes 40 through which to drain out drain water generated at the heat exchanger 2, the drainage structure 7 disposed below the heat exchanger 2 and that guides drain water to the bottom plate 4, and the heating means 6 that heats the drainage structure 7. The drainage structure 7 includes the side panel 3 covering each side of the housing 1, and the water guide plate 5 disposed inside the housing 1 and facing the side panel 3. The water guide plate 5 and the side panel 3 define the drainage path 70 for draining drain water between the water guide plate 5 and the side panel 3. The heating means 6 is configured to heat at least an upper portion of the side panel 3.

More specifically, in the outdoor unit 100 of an air-conditioning apparatus according to Embodiment 1, even if a lower portion of the drainage path 70 becomes buried in icing and then the icing increases to an upper portion of the interior of the drainage path 70, the icing is melted by the heating means 6 and, as illustrated in FIG. 12, drained to the outside of the side panel 3 from an upper end portion of the drainage path 70. Therefore, the outdoor unit 100 of an air-conditioning apparatus makes it possible to prevent a decrease in the heating capacity of the heat exchanger 2 and breakage of the refrigerant pipe, and further prevent entry of dripping drain water into an inner portion of the housing 1.

The heating means 6 includes the heater 60, and the temperature detection means 61 that detects the temperature of the surroundings heated by the heater 60. Therefore, in the outdoor unit 100 of an air-conditioning apparatus, for example, the heater 60 is controlled on the basis of a temperature detected by the temperature detection means 61. This helps to ensure the safety of the heating means 6 disposed outside the housing 1.

The heater 60 is positioned at the center along the breadth of the side panel 3. Therefore, in the outdoor unit 100 of an air-conditioning apparatus, increased heating is applied to the central portion along the breadth of the side panel 3. This makes it possible to improve the efficiency of drainage by causing drain water from the left and right sides to be collected in the central portion.

The heating means 6 is disposed such that the heating means 6 faces the outer surface of the side panel 3, and retained by the mounting bracket 8 disposed outward from the outer surface of the side panel 3. For example, for a case where an anti-freeze heater is post-installed onto the bottom plate as with the Patent Literature 1, it is necessary to remove the side panel from the housing, and then remove a compressor, a control box, and other internal components installed on the bottom plate to thereby mount the anti-freeze heater. Such mounting of the anti-freeze heater is thus difficult. By contrast, the outdoor unit 100 of an air-conditioning apparatus eliminates the need to remove components installed on the bottom plate, such as a compressor and a control box. This facilitates mounting of the heating means 6.

The first heat-insulating component 63 and the second heat-insulating component 64 are disposed between the heating means 6 and the side panel 3. That is, with the outdoor unit 100 of an air-conditioning apparatus, melting of the ice inside the drainage path 70 by the heater 60 is inhibited to thereby reduce a freezing-and-melting process of the ice inside the drainage path 70. This helps to prevent deformation of the water guide plate 5, which is a resin panel.

The mounting bracket 8 has the shape of a rectangular box with an open side facing the side panel 3, and has the lower flange part 83 extending along the lower edge of the open side and projecting outward. The first cushioning component 84 is disposed between the lower flange part 83 and the side panel 3. The above-mentioned configuration of the outdoor unit 100 of an air-conditioning apparatus makes it possible to confine heat inside the mounting bracket 8, which allows for efficient heating of an upper portion of the side panel 3. The above-mentioned configuration also helps to prevent water droplets from entering the interior space through the gap between the lower flange part 83 and the side panel 3.

The second cushioning components 85 are each disposed inside the mounting bracket 8 and adjacent to the corresponding one of the left and right sides of the mounting bracket 8. The above-mentioned configuration of the outdoor unit 100 of an air-conditioning apparatus helps to prevent water from entering the interior space enclosed by the side panel 3 and the mounting bracket 8, thus protecting the heating means 6 from water.

The mounting bracket 8 is sized to fit within the range S of less than or equal to 15 mm in a horizontally outward direction from the outer surface of the side panel 3. The above-mentioned configuration of the outdoor unit 100 of an air-conditioning apparatus helps to ensure that, if plural outdoor units 100 are arranged successively side by side in a concentrated manner, interference between adjacent outdoor units 100 is reduced to thereby increase available installation space to the extent possible.

The side panel 3 has the first hook-shaped part 30, which is formed by bending an upper end portion of the side panel 3 toward the interior of the housing 1. The mounting bracket 8 has the second hook-shaped part 80*a*, which is formed by bending an upper end portion of the mounting bracket 8 toward the interior of the housing 1. The mounting bracket 8 is mounted to the outer surface of the side panel 3 by placing the second hook-shaped part 80*a* over the first hook-shaped part 30. Therefore, in the outdoor unit 100 of an air-conditioning apparatus, the first hook-shaped part 30 is covered by the second hook-shaped part 80*a* to thereby block the route of water entry, thus preventing entry of water into the interior space enclosed by the side panel 3 and the mounting bracket 8. In other words, the heating means 6 retained inside the mounting bracket 8 is protected from water. This helps to prevent the heating means 6 from breaking down. Further, the mounting bracket 8 is retained to the side panel 3 by simply hooking the first hook-shaped part 30 over the second hook-shaped part 80*a*. This helps to facilitate installation.

The sealing component 86 is disposed in the gap between an upper portion of the mounting bracket 8 and an upper portion of the side panel 3 and seals the gap. The above-mentioned configuration of the outdoor unit 100 of an air-conditioning apparatus makes it possible to completely block the route of water entry between the upper portion of the mounting bracket 8 and the upper portion of the side panel 3. This helps to reliably prevent water from entering the interior space enclosed by the side panel 3 and the mounting bracket 8.

The inner metal sheet 9 is disposed inside the mounting bracket 8 between the heating means 6 and the side panel 3 and protects the heating means 6. The above-mentioned configuration of the outdoor unit 100 of an air-conditioning apparatus makes it possible to protect the heating means 6 from water, and also improve internal heat retention by protecting the heating means 6 from the side panel 3, which has been cooled by exposure to the outside air.

The mounting bracket 8 has the first extraction opening 87 through which to pass the wire 62 connected to the heating means 6. The inner metal sheet 9 has the second extraction openings 92 through which to pass the wire 62 connected to the heating means 6. The second extraction openings 92 are positioned offset such that the second extraction openings 92 are prevented from overlapping with the first extraction opening 87. Therefore, with the outdoor unit 100 according to Embodiment 1, even if water droplets enter the outdoor unit 100 through the first extraction opening 87, the water is held back between the first extraction opening 87 and the second extraction openings 92 to prevent the water from reaching the heating means 6. This helps to prevent the heating means 6 from breaking down because of the entry of water.

Figure 13:
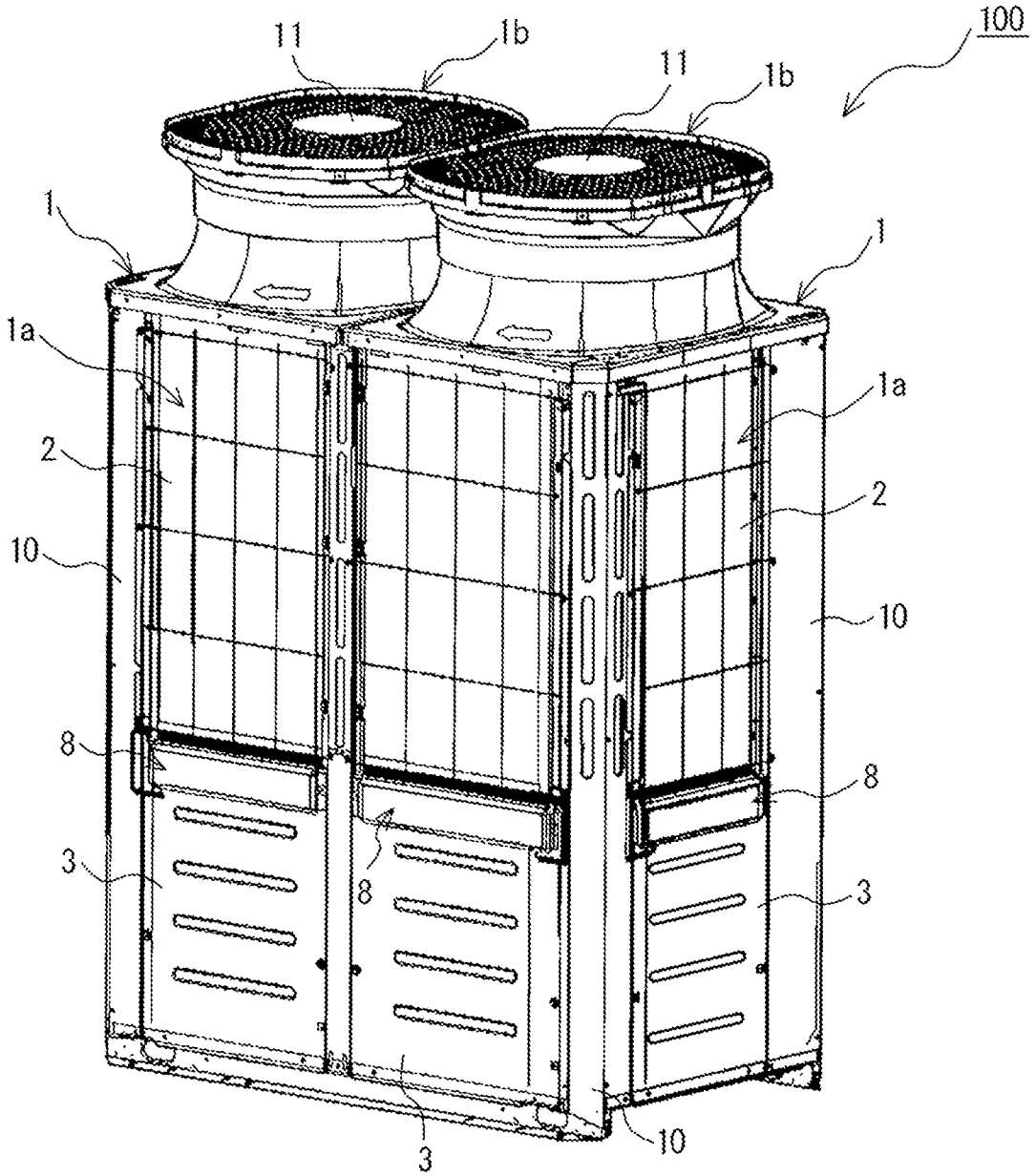
FIG. 13 is a perspective view of a modification of the outdoor unit of an air-conditioning apparatus according to Embodiment 1 of the present disclosure.

FIG. 13 is a perspective view of a modification of the outdoor unit of an air-conditioning apparatus according to Embodiment 1 of the present disclosure. The outdoor unit of an air-conditioning apparatus illustrated in FIG. 1 includes the heating means 6 provided to one of the four sides of the housing 1. Alternatively, as illustrated in FIG. 13, the outdoor unit may include the heating means 6, which is retained by use of the mounting bracket 8, provided to each of two or more of the four sides of the housing 1.

Figure 14:
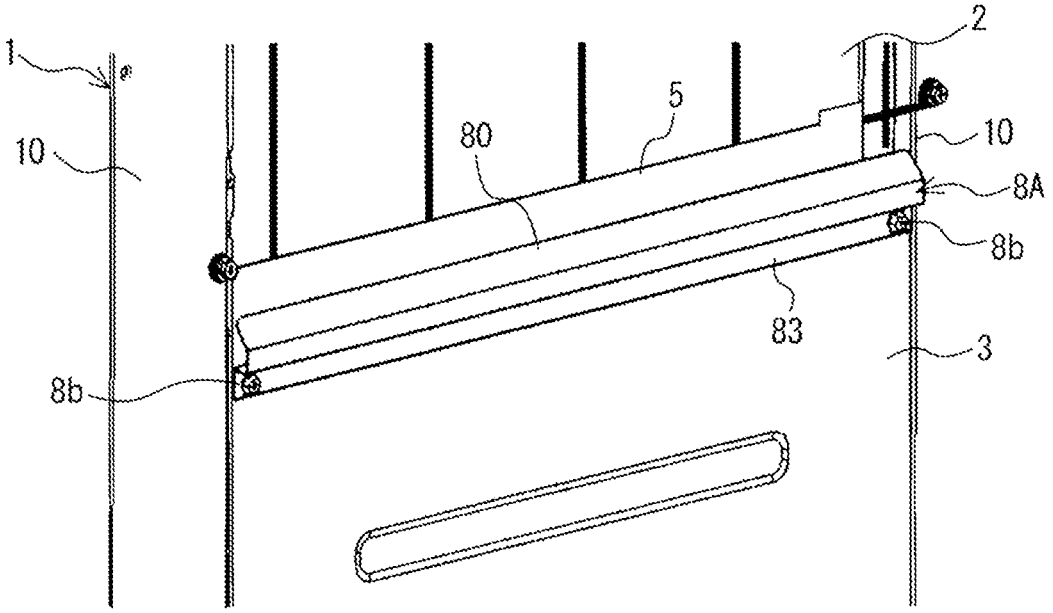
FIG. 14 is an enlarged view of a relevant portion of the outdoor unit of an air-conditioning apparatus according to Embodiment 1 of the present disclosure, illustrating a modification of the mounting bracket.

FIG. 14 is an enlarged view of a relevant portion of the outdoor unit of an air-conditioning apparatus according to Embodiment 1 of the present disclosure, illustrating a modification of the mounting bracket. A mounting bracket 8A in FIG. 14 is formed by bending a steel plate into a U-shape in cross-section, and has an open side that faces the side panel 3. The mounting bracket 8A has the upper surface 80 inclined toward the housing 1. The mounting bracket 8A may have the second hook-shaped part 80*a* in an upper end portion of the upper surface 80 as illustrated in FIG. 7. The lower edge of the open side of the mounting bracket 8A has the lower flange part 83 that projects outward. The mounting bracket 8A is joined at the lower flange part 83 to the frame 10 with the joining component 8*b* such as a screw. The left and right sides of the mounting bracket 8A are open. The mounting bracket 8A is of a simple structure, which allows for reduced manufacturing cost.

Embodiment 2

Figure 15:
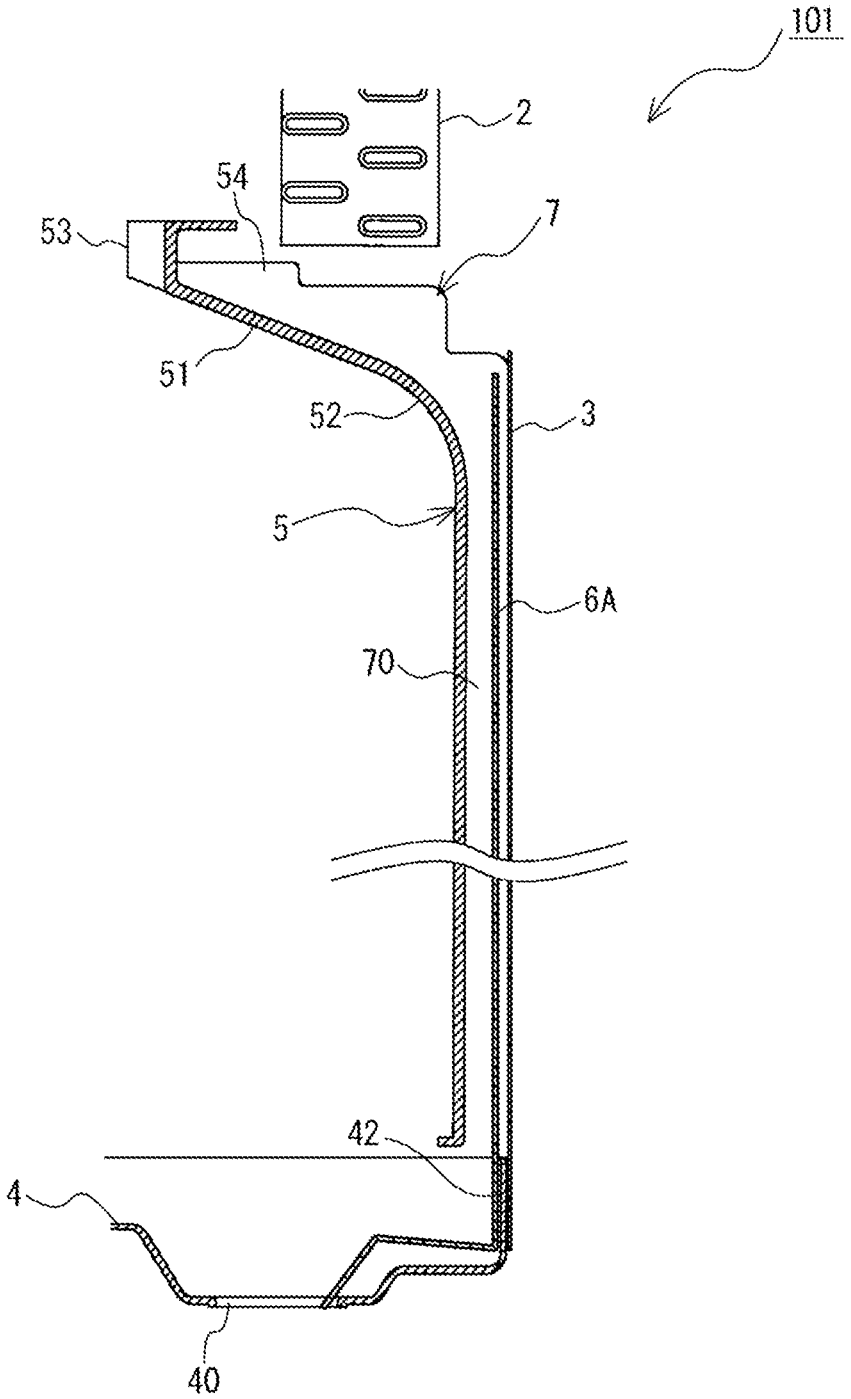
FIG. 15 is a schematic cross-sectional view of a drainage structure of an outdoor unit of an air-conditioning apparatus according to Embodiment 2 of the present disclosure.

An outdoor unit of an air-conditioning apparatus according to Embodiment 2 is described below with reference to FIG. 15. FIG. 15 is a schematic cross-sectional view of a drainage structure of the outdoor unit of an air-conditioning apparatus according to Embodiment 2 of the present disclosure. Components identical to those of the outdoor unit 100 of an air-conditioning apparatus described in Embodiment 1 are designated by the same reference signs, and further descriptions of such components are omitted as appropriate.

As illustrated in FIG. 15, an outdoor unit 101 of an air-conditioning apparatus according to Embodiment 2 includes a heating means 6A in the form of a panel heater that heats the entire surface of the side panel 3. The heating means 6A is disposed between the side panel 3 and the water guide plate 5, and extends to reach the location where the drainage holes 40 are provided through the bottom plate 4. In one example, the heating means 6A is mounted to the frame 10 with a joining component such as a screw. In the outdoor unit 101 of an air-conditioning apparatus according to Embodiment 2, the drainage path 70 defined by the side panel 3 and the water guide plate 5 is heated by the heating means 6A. This prevents icing from increasing upward inside the drainage path 70. As a result, even under cold climate environments, drain water is guided to the drainage groove 41 of the bottom plate 4 and efficiently drained away.

For the outdoor unit 101 of an air-conditioning apparatus according to Embodiment 2, the heating means 6A is only required to be capable of heating the entire surface of the side panel 3. The heating means 6A may not necessarily extend to reach any of the drainage holes 40 of the bottom plate 4.

Embodiment 3

Figure 16:
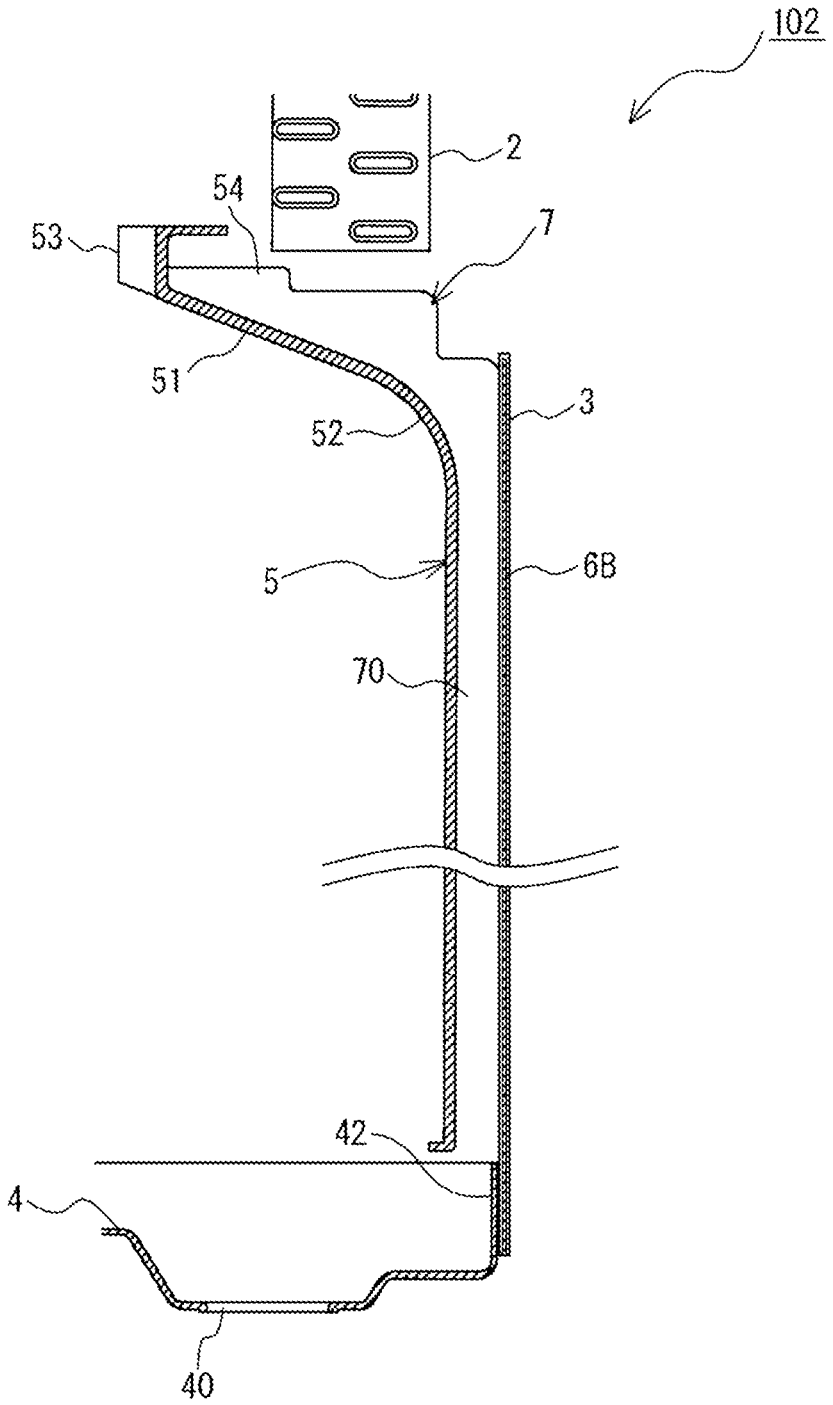
FIG. 16 is a schematic cross-sectional view of a drainage structure of an outdoor unit of an air-conditioning apparatus according to Embodiment 3 of the present disclosure.

An outdoor unit of an air-conditioning apparatus according to Embodiment 3 is described below with reference to FIG. 16. FIG. 16 is a schematic cross-sectional view of a drainage structure of the outdoor unit of an air-conditioning apparatus according to Embodiment 3 of the present disclosure. Components identical to those of the outdoor unit 100 of an air-conditioning apparatus described in Embodiment 1 are designated by the same reference signs, and further descriptions of such components are omitted as appropriate.

As illustrated in FIG. 16, an outdoor unit 102 of an air-conditioning apparatus according to Embodiment 3 includes a heating means 6B, which is in the form of a panel heater for heating the entire surface of the side panel 3 and built in the side panel 3. In the outdoor unit 102 of an air-conditioning apparatus according to Embodiment 3 as well, the drainage path 70 defined by the side panel 3 and the water guide plate 5 is heated by the heating means 6B. This prevents icing from increasing upward inside the drainage path 70. As a result, even under cold climate environments, drain water is guided to the drainage groove 41 of the bottom plate 4 and efficiently drained away.

Although the present disclosure has been described above with reference to its embodiments, the present disclosure is not limited to the embodiments described above. For example, the internal configuration of the outdoor unit 100 illustrated in the drawings is illustrative only and not limited to the specific details described herein. The outdoor unit 100 may include components other than those mentioned above. The heating means 6 described in Embodiment 1 may not necessarily be disposed such that the heating means 6 faces the outer surface of the side panel 3 but may be mounted to any other location, for example, the heat exchanger 2, as long as the heating means 6 is configured to heat at least an upper portion of the side panel 3. The mounting bracket 8 is not limited to the specific form described above but may be in any other form as long as the mounting bracket 8 retains the heating means 6. In short, the scope of the present disclosure encompasses all such variations in design and application as may be made by those of ordinary skill in the art without departing from the technical ideas of the present disclosure.

REFERENCE SIGNS LIST

1 housing 1*a* air inlet 1*b* air outlet 2 heat exchanger 3 side panel bottom plate 5 water guide plate 6, 6A, 6B heating means 7 drainage structure 8, 8A mounting bracket 8*a* through-hole 8*b* joining component 9 inner metal sheet 9*a* left flange surface 9*b* right flange surface 9*c* lower flange surface 10 frame 11 fan 12 internal component 20 support base 30 first hook-shaped part 40 drainage hole 41 drainage groove 42 rising part 50 drainage surface 51 inclined part 52 curved part 53, 54 flange part 55 longitudinal rib 56 mounting component 57 through-hole 60 heater 61 temperature detection means 62 wire 63 first heat-insulating component 64 second heat-insulating component 70 drainage path 80 upper surface 80*a* second hook-shaped part 81 left flange part 82 right flange part 83 lower flange part 84 first cushioning component 85 second cushioning component 86 sealing component 87 first extraction opening 90 through-hole 91 joining component 92 second extraction opening 100, 101, 102 outdoor unit

The invention claimed is:

1. An outdoor unit of an air-conditioning apparatus, comprising:

a housing that has an opening through a side of the housing;

a heat exchanger disposed in an interior of the housing;

a bottom plate disposed at a bottom of the housing, the bottom plate having a drainage hole through which drain water generated at the heat exchanger drains out;

a drainage structure disposed below the heat exchanger and that guides the drain water to the bottom plate; and a heating means configured to heat the drainage structure, the drainage structure including a side panel that covers the opening of the housing, and a water guide plate disposed inside the housing and facing the side panel, the water guide plate and the side panel defining a drainage path for draining the drain water between the water guide plate and the side panel, the heating means being configured to heat at least a portion of the side panel.

2. The outdoor unit of an air-conditioning apparatus of claim 1, wherein the heating means includes a heater, and a temperature detection means configured to detect a temperature of surroundings heated by the heater.

3. The outdoor unit of an air-conditioning apparatus of claim 2, wherein the heater is positioned at a center of the side panel in a direction of breadth of the side panel.

4. The outdoor unit of an air-conditioning apparatus of claim 1, wherein the heating means is disposed such that the heating means faces an outer surface of the side panel, and is retained by a mounting bracket, the mounting bracket being disposed outward from the outer surface of the side panel.

5. The outdoor unit of an air-conditioning apparatus of claim 4, wherein a heat-insulation component is disposed between the heating means and the side panel.

6. The outdoor unit of an air-conditioning apparatus of claim 4, wherein the mounting bracket has a shape of a rectangular box with an open side that faces the side panel, the mounting bracket having a lower flange part that extends along a lower edge of the open side and projects outward.

7. The outdoor unit of an air-conditioning apparatus of claim 6, wherein a first cushion component is disposed between the lower flange part and the side panel.

8. The outdoor unit of an air-conditioning apparatus of claim 6, wherein second cushion components are each disposed inside the mounting bracket and adjacent to a corresponding one of left and right sides of the mounting bracket.

9. The outdoor unit of an air-conditioning apparatus of claim 4, wherein the mounting bracket is sized to fit within a range of less than or equal to 15 mm in a horizontally outward direction from the outer surface of the side panel.

10. The outdoor unit of an air-conditioning apparatus of claim 4, wherein the side panel has a first hook-shaped part, the first hook-shaped part being formed by bending an end portion of the side panel toward the interior of the housing, wherein the mounting bracket has a second hook-shaped part, the second hook-shaped part being formed by bending an end portion of the mounting bracket toward the interior of the housing, and wherein the mounting bracket is mounted to the outer surface of the side panel by placing the second hook-shaped part over the first hook-shaped part.

11. The outdoor unit of an air-conditioning apparatus of claim 10, wherein a sealant is disposed in a gap between an upper portion of the mounting bracket and an upper portion of the side panel and seals the gap.

12. The outdoor unit of an air-conditioning apparatus of claim 4, wherein an inner metal sheet is disposed inside the mounting bracket, the inner metal sheet being disposed between the heating means and the side panel and protecting the heating means.

13. The outdoor unit of an air-conditioning apparatus of claim 12, wherein the mounting bracket has a first extraction opening through which to pass a wire connected to the heating means, and wherein the inner metal sheet has a second extraction opening through which to pass the wire connected to the heating means, the second extraction opening being positioned offset such that the second extraction opening is prevented from overlapping with the first extraction opening.

14. The outdoor unit of an air-conditioning apparatus of claim 1, wherein the heating means is a panel heater configured to heat an entire surface of the side panel.

15. The outdoor unit of an air-conditioning apparatus of claim 14, wherein the heating means is disposed between the side panel and the water guide plate.

16. The outdoor unit of an air-conditioning apparatus of claim 15, wherein the heating means extends to reach the drainage hole of the bottom plate.

17. The outdoor unit of an air-conditioning apparatus of claim 14, wherein the heating means is built in the side panel.

* * * * *